United States Patent [19]

Principe

[11] 4,269,131

[45] May 26, 1981

[54] THREAD CONTROL DEVICE FOR STITCHING MACHINES

[75] Inventor: Viktor Principe, Romanshorn, Switzerland

[73] Assignee: Arthur Schmid AG, Romanshorn, Switzerland

[21] Appl. No.: 60,786

[22] Filed: Jul. 25, 1979

[51] Int. Cl.[3] ..... D05B 47/04; D05B 69/36

[52] U.S. Cl. ..... 112/273; 112/254; 112/302

[58] Field of Search ..... 112/273, 278, 302, 254, 112/255

[56] References Cited

U.S. PATENT DOCUMENTS

| | | | |
|---|---|---|---|
| 3,009,433 | 11/1961 | Kuhn | 112/273 |
| 3,687,095 | 8/1972 | Jackson | 112/273 X |
| 4,018,175 | 4/1977 | Forrester et al. | 112/254 |
| 4,166,423 | 9/1979 | Brienza et al. | 112/254 |

*Primary Examiner*—Peter P. Nerbun

*Attorney, Agent, or Firm*—Thomas W. Speckman

[57] ABSTRACT

Thread control device for stitching machines comprising a mechanism for applying torque to a feed roller around which the needle thread is fed to provide proper thread feed when a small number of threads are used and to provide control of seam variation. The device further has a thread break monitoring device signaling the program control in case of thread breakage to stop the device.

5 Claims, 3 Drawing Figures

THREAD CONTROL DEVICE FOR STITCHING MACHINES

BACKGROUND OF THE INVENTION

1. Field of the Invention

The present invention concerns a device for the control of the threads on a stitching machine. The output of modern stitching machines is so high that the control of the threads is extremely important. In contrast to the knitting machine, in which a very large number of threads are used, the feed is relatively low and the failure of a thread through thread breakage in a stitching machine means the loss of the material. This is all the more serious in that the number of the stitching seams for certain products is tending to decrease and the material feed rate is becoming higher and higher. Modern stitching machines operate with outputs of an average of 30–80 m/hr. In the production of auto upholstery often only two or three seams are stitched, with a speed of 100 m/hr being achieved.

2. Description of the Prior Art

This problem has been recognized and a solution has also been proposed. In Swiss Patent CH-PS357.955 a proposal is made to loop the needle thread from a supply spool around a roller and pass it through a terminal eye of a spring-loaded current-conducting contact arm. If the thread tension decreases as the result of a thread break, the contact arm presses on a contact bar and closes a circuit, whereby a relay is activated and the machine shut off. This system has proven its worth for stitching patterns with a relatively large number of stitching seams. With the very simple stitching patterns, such as cushion trimmings and auto upholstery with only a few stitching seams, which have become more and more prevalent recently, it has been found that when using only a few threads, the thread loop around the roller which is required to provide the thread tension does not work. Rather, just from the inertia in the system, the threads are frequently broken. Hence, in the stitching of auto upholstery, despite the high working speed, the work is performed without automatic thread control.

SUMMARY OF THE INVENTION

The present invention provides a thread controlling device that is particularly adapted for the control for stitching machines in the production of stitched products with only a few stitched seams. Further, the device can influence the location of the stitched seams.

The thread controlling device of this invention is characterized by the fact that a control regulates the thread feed according to a program of the program control of the stitching machine by means of a drive mechanism and that the thread breakage control device that indicates the break of a thread is connected with the program control.

BRIEF DESCRIPTION OF THE DRAWING

Objects, advantages and features of this invention will be apparent from the description together with the drawings showing preferred embodiments wherein.

DESCRIPTION OF PREFERRED EMBODIMENTS

Modern stitching machines, such as, for example, the AZ-Designer machine of the firm MECA S.N.C. in Cassano Magnago, Italy, have program control. By means of programmable magnetic discs, the user can stitch each stitching pattern desired by his customer fully automatically. The device based on this invention makes use of this feature.

Figure 1:
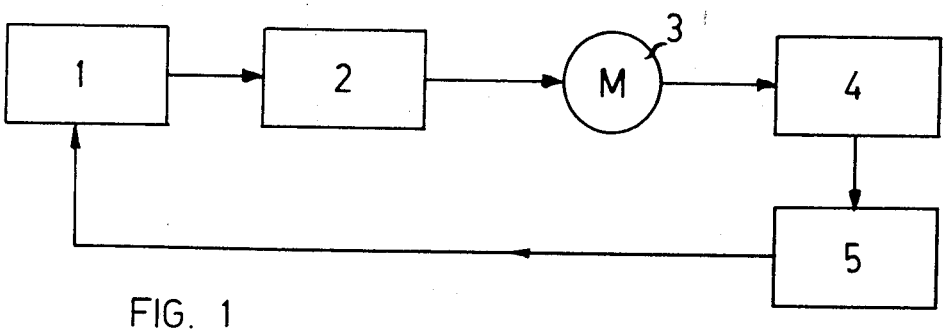
FIG. 1 shows a schematic operation diagram of the thread control device.

In the operation diagram shown in FIG. 1, the program control of the stitching machine is indicated by 1. Corresponding to the pattern which is fed into the central program control 1 of the machine with a magnetic card or punched tape, control signals are sent to control 2 of the thread control device. This control device transforms the received signals and transmits them to step motor 3. Step motor 3 drives a roller which has all the threads being used looped around it and effects the corresponding thread feed 4. A thread break monitoring device 5 monitors each individual thread being used. When a break occurs, a back signal is given to the program control of the machine and the machine stops.

In contrast to the heretofore existing thread monitors for textile machines, in the device based on this invention not only is the thread monitored, but the thread feed of the needle thread is controlled. The control of the needle thread also has, of course, an effect on the shuttle thread.

The control 2 of the thread control device can take care of several functions. For example, the control can be so designed that the number of threads used in the stitching pattern can be adjusted. If, for example, all the stitching threads are required, then the feed roller hardly needs to be driven, since threads rotate the feed roller by themselves. The fewer the threads used, the more the step motor 3 must do for the feeding through the feed roller. If, as is quite usual in car upholstery, only two or three threads are required, then the feed must coincide exactly with the required thread length.

Figure 3A:
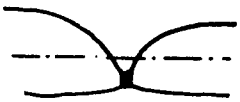
FIGS. 3*a–c* show different stitching variants that can be produced with the thread control device according to this invention.
Figure 3B:
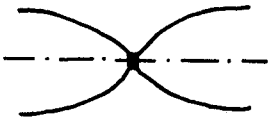
Figure 3C:
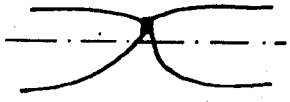

It is well known that a seam can be varied through the tension of the needle thread. FIGS. 3*a–c* show a cross section vertical to a quilting seam through quilting material. The form of a quilting seam as in FIG. 3*a* results when the tension of the shuttle thread is considerably greater than the tension of the needle thread. With the device based on the invention, this can be achieved by making the feed of the needle thread relatively large by means of the step motor and thereby the tension of the needle thread relatively low. If the tensions of the needle and shuttle threads are the same, the same amount of thread is used on either side and the approximately symmetrical seam form of FIG. 3*b* results. Finally, the tension of the needle threads can be raised so much that a seam form, as shown in FIG. 3*c*, results. These types of seams, as shown in FIG. 3*c*, have been hitherto unknown. The operator has always made an effort to obtain a stitching seam as shown in FIG. 3*b*. It was, in principle, possible to brake the individual needle threads, but this was never done in practice. The device based on this invention makes it possible now not only to work with any seam variant, but also to vary, at will, the type of seam during the stitching, which means that a more relief-like effect can be obtained.

Figure 2:
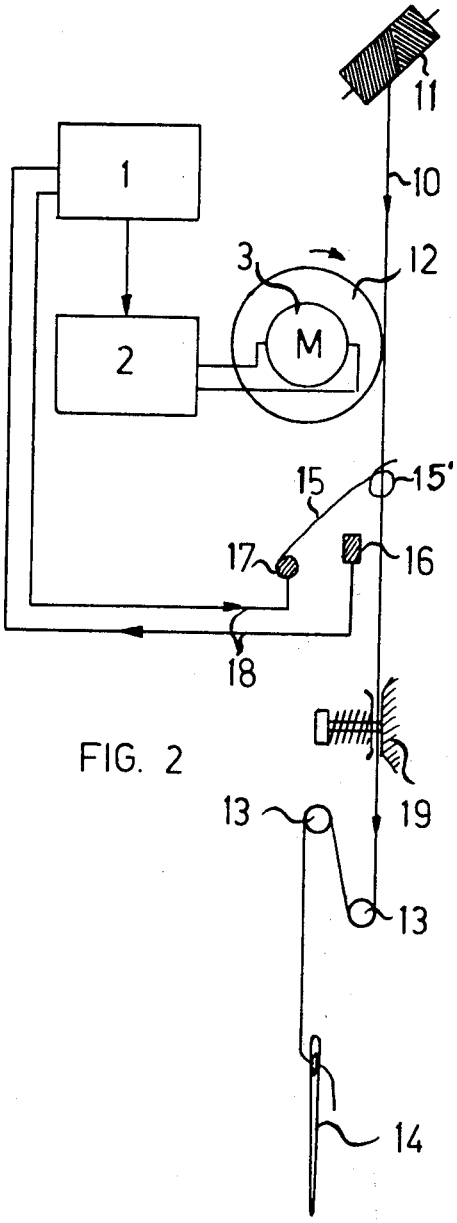
FIG. 2 shows a schematic representation of a thread control device according to this invention.

FIG. 2 shows the thread control device according to the invention in a schematic representation. Needle thread 10 comes off the spool 11 and goes around a roller 12, which, because of its function, is called the feed roller. The feed roller 12, which is responsible for the follow-up of the needle thread 10, also correspondingly adjusts the thread tension. The feed roller 12 is driven by step motor 3 in accordance with control 2 of the thread controlling device. Thread 10 reaches needle 14 via guide rollers 13, which may be partly spring loaded.

Thread break monitoring device 5 monitors needle thread 10. The monitoring device 5 consists of a spring-loaded conductive contact arm 15 with terminal eye 15' around a needle thread 10 and a common contact bar 16 for all contact arms 15. All the contact arms 15 mounted on a conductive bar 17, as well as the contact bar 16, are connected with the program control 1 of the stitching machine by way of lines 18 and a relay, not shown. If the needle thread breaks or the thread tension becomes too small, contact arm 15 touches contact bar 16, closes the relay circuit and turns off the machine through the program control 1. This also happens if the thread break occurs beyond the thread disk brake 19, since thread 10 fed from the roller 12 is no longer tightened. On the other hand, if the not-shown shuttle thread breaks, less needle thread is used than is programmed, i.e., more thread is fed than is needed, and consequently the thread 10 again becomes slack, causing the contact 15-16 again to close.

An advantage of this invention is that with the described thread control device not only, as previously, can needle thread breakage be controlled, but in addition to this function, new quilting stitching variants can also be executed.

In a quilting-stitching machine with program control (1) it is possible by means of a device for the controlling of the needle thread, on the one hand, to monitor thread breaks and, on the other, to vary the stitching seam. For this purpose the thread (10) is carried around a feed roller (12) which effects the feed of the thread according to the stitching program through the control (2). The roller (12) is driven by a step motor (3). The thread feed is adjusted on the basis of the number of the threads used and the desired seam. The thread-break monitoring device (15-19) influences the program control (1) again and thereby also all the successive elements (2,3).

The device makes it possible to work with few threads (10), as is often desired in the production of upholstery.

Thread control means 2, may be of any suitable electronic circuitry as is known to the art, to activate mechanism means 3 in the manner as described above, such as relays.

The thread control device for stitching machines according to this invention comprises a program control means (1), a thread control means (2) controlling thread feed means (4) by means of activating mechanism means (3) according to a program of the program control means (1) of the stitching machine for controlling thread tension, and a thread-break monitoring device (5) consisting of several spring-loaded, current-conducting contact arms (15) each with a terminal eye (15'), through which a needle thread (10) is led from thread spool (11) and a contact bar (16), as well as a thread disc brake (19) for the maintenance of the thread tension of each thread, said thread-break monitoring device (5) that announces the breakage of a thread being connected with the program control means (1).

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a thread control device for stitching machines of the type having a program control means (1), a thread-break monitoring device (5) having resilient current-conducting contact arms (15) each with a terminal eye (15') through which a needle thread (10) is led from thread spool 11 and a contact bar (16), and a thread disc brake (19) each required for maintaining thread tension of each thread, the improvement comprising: said program control means (1) is adapted to move a feed roller (12) by means of step motor (3) in accordance with the number of needle threads (10) in operation whereby needle threads (10) are guided around feed roller (12), said needle threads effecting a part of the rotational movement of the feed roller (12).

2. A device as defined in claim 1, characterized by the fact that the thread-break monitoring device (5) is located between feed roller (12) and a thread disc brake (19).

3. A device as defined in claim 1 characterized by said roller (12) braking individual needle threads (10) to result in a stitching seam above the seam obtained when tension of the needle and shuttle threads are the same.

4. A device as defined in claim 1 characterized by multiple needle threads (10) around feed roller (12) provide a large amount of the torque to drive said feed roller (12).

5. A device as defined in claim 1 characterized by few needle threads (10) around feed roller (12) and a large amount of the torque to drive said feed roller (12) is provided by said step motor (3).

* * * * *